US011406212B2

(12) United States Patent
Odeh

(10) Patent No.: US 11,406,212 B2
(45) Date of Patent: Aug. 9, 2022

(54) SMART MAILBOX DEVICE, SYSTEM AND METHOD OF USING THE SAME

(71) Applicant: Ashraf Odeh, Ellicott City, MD (US)

(72) Inventor: Ashraf Odeh, Ellicott City, MD (US)

( * ) Notice: Subject to any disclaimer, the term of this patent is extended or adjusted under 35 U.S.C. 154(b) by 0 days.

(21) Appl. No.: 17/198,990

(22) Filed: Mar. 11, 2021

(65) Prior Publication Data

US 2021/0282581 A1 Sep. 16, 2021

Related U.S. Application Data

(60) Provisional application No. 62/988,032, filed on Mar. 11, 2020.

(51) Int. Cl.

| | |
|---|---|
| ***A47G 29/22*** | (2006.01) |
| ***A47G 29/14*** | (2006.01) |
| ***A47G 29/20*** | (2006.01) |

(52) U.S. Cl.

CPC ..... *A47G 29/22* (2013.01); *A47G 29/14* (2013.01); *A47G 29/141* (2013.01); *A47G 29/20* (2013.01); *A47G 2029/144* (2013.01); *A47G 2029/145* (2013.01); *A47G 2029/149* (2013.01)

(58) Field of Classification Search

CPC ..... A47G 29/124; A47G 29/22; A47G 29/14; A47G 29/141; A47G 29/20; A47G 2029/144; A47G 2029/145; A47G 2029/149; B65D 7/24; B65D 21/086; B65D 33/00; B65D 33/14

USPC ..... 232/1 E, 17, 19, 38, 45; 340/569; 220/6, 220/476; 383/12, 22

See application file for complete search history.

(56) References Cited

U.S. PATENT DOCUMENTS

| | | | | |
|---|---|---|---|---|
| 1,451,343 | A * | 4/1923 | Panagopolous | A47G 29/1207 232/30 |
| 2,456,479 | A * | 12/1948 | Antil | A47G 29/14 220/6 |
| 4,785,960 | A * | 11/1988 | Belisle | B65D 33/28 220/23.83 |
| 5,368,226 | A * | 11/1994 | Franceschino | A47G 29/1223 232/19 |
| 6,426,699 | B1 * | 7/2002 | Porter | A47F 10/00 221/2 |
| 9,121,199 | B2 | 9/2015 | Li | |
| 9,336,667 | B2 | 5/2016 | Hammoud | |

(Continued)

FOREIGN PATENT DOCUMENTS

| | | |
|---|---|---|
| EP | 3235408 A1 | 10/2017 |
| GB | 2572137 A | 4/2018 |

*Primary Examiner* — William L Miller

(74) *Attorney, Agent, or Firm* — Patent Insider

(57) ABSTRACT

Disclosed herein are methods and systems for providing a smart mailbox device comprising a touch screen user interface display; a smart doorbell notification interface; a smart camera apparatus; an axle member; a computing device having capabilities including at least of: wireless communication, location tracking, cloud computing, remote access, device management, and computing functions; a secure attachment member; a retractable bag configured to: retract a receptacle as a package carrier approaches the smart mailbox device, receive at least one package, secure the at least one package; and a retractable security band configured to: retract for attachment to at least one package above a retractable bag threshold size, adhere and secure to at least one package above a retractable bag threshold size.

18 Claims, 13 Drawing Sheets

(56) References Cited

U.S. PATENT DOCUMENTS

| | | | | |
|---|---|---|---|---|
| 9,861,221 | B2 * | 1/2018 | Jiang | A47G 29/141 |
| 10,076,204 | B1 * | 9/2018 | Sadeghi | A47G 29/141 |
| 10,143,320 | B1 | 12/2018 | Batts | |
| 10,282,951 | B1 | 5/2019 | Kulick | |
| 10,299,617 | B1 * | 5/2019 | Castellanos | A47G 29/141 |
| 10,321,780 | B1 | 6/2019 | James | |
| 10,537,196 | B1 * | 1/2020 | MacPherson | A47G 29/141 |
| 10,682,002 | B2 * | 6/2020 | Miller | A47G 29/20 |
| 10,709,276 | B2 * | 7/2020 | Guanch | A47G 29/20 |
| 10,743,695 | B1 * | 8/2020 | Altmaier | A47G 29/20 |
| 11,109,705 | B2 * | 9/2021 | Raphael | A47B 96/16 |
| 11,197,566 | B2 * | 12/2021 | Aresu | A47G 29/12 |
| 2010/0085148 | A1 * | 4/2010 | Nesling | G07C 9/00912 340/5.73 |
| 2013/0077896 | A1 * | 3/2013 | Wiley | A47G 29/20 383/86.2 |
| 2016/0051073 | A1 * | 2/2016 | Heinz | A47G 29/141 232/39 |
| 2016/0068306 | A1 * | 3/2016 | Heinz | B65D 81/02 220/560.01 |
| 2017/0127868 | A1 * | 5/2017 | Adewuyi | A47G 29/141 |
| 2018/0202199 | A1 * | 7/2018 | Critz | B65D 33/34 |
| 2018/0260777 | A1 * | 9/2018 | Judge | G07C 9/00896 |
| 2019/0133362 | A1 * | 5/2019 | Gilligan | A47G 29/141 |
| 2019/0218828 | A1 | 7/2019 | Ruth et al. | |
| 2019/0225375 | A1 * | 7/2019 | Sena | A47G 29/141 |
| 2019/0246828 | A1 | 8/2019 | Miller | |
| 2019/0320836 | A1 * | 10/2019 | Guanch | A47G 29/20 |
| 2020/0015617 | A1 * | 1/2020 | Izquierdo Gonzalez | A47G 29/20 |
| 2020/0060460 | A1 * | 2/2020 | Farrar | A47G 29/141 |
| 2020/0107663 | A1 * | 4/2020 | Eivaz | A47G 29/20 |
| 2021/0267401 | A1 * | 9/2021 | Benevento | A47G 29/20 |

* cited by examiner

SMART MAILBOX DEVICE, SYSTEM AND METHOD OF USING THE SAME

FIELD OF PRESENT DISCLOSURE

The present disclosure relates to mailbox receptacles. Furthermore, the present disclosure relates to at least one of the following CPC classifications: (B65G1/00 Storing articles, individually or in orderly arrangement, in warehouses or magazines (conveyor combinations in warehouses, magazines or workshops B65G37/00; stacking of articles B65G57/00; removing articles from stacks B65G59/00; loading machines B65G65/02); A47G29/00 Miscellaneous supports, holders, or containers for household use (for drying towels A47K10/04; stands, racks, or the like for airing beds, garments, or the like, clothes, drying devices D06F57/00); G09 F3/0352 Forms or constructions of security seals characterized by the type of seal used having padlock-type sealing means using cable lock; A47G29/20 Deposit receptacles for food, e.g. breakfast, milk, or large parcels; Similar receptacles for food or large parcels with appliances for preventing unauthorized removal of the deposited articles, i.e. food or large parcels with appliances for preventing unauthorized removal of the deposited articles; A47G2029/146 Deposit receptacles for food, e.g. breakfast, milk, or large parcels; Similar receptacles for food or large parcels with appliances for preventing unauthorized removal of the deposited articles, i.e. food or large parcels comprising electronically controlled locking means the receptacle comprising identification means, e.g. a bar code; A47G2029/144 Deposit receptacles for food, e.g. breakfast, milk, or large parcels; Similar receptacles for food or large parcels with appliances for preventing unauthorized removal of the deposited articles, i.e. food or large parcels comprising electronically controlled locking means the receptacle being transportable and attachable to a building; A47G29/141 Deposit receptacles for food, e.g. breakfast, milk, or large parcels; Similar receptacles for food or large parcels with appliances for preventing unauthorized removal of the deposited articles, i.e. food or large parcels comprising electronically controlled locking means; A47G29/22 Deposit receptacles for food, e.g. breakfast, milk, or large parcels; Similar receptacles for food or large parcels with appliances for preventing unauthorized removal of the deposited articles, i.e. food or large parcels with appliances for preventing unauthorized removal of the deposited articles having rotatable or reciprocal parts; A47G29/16 Combinations with letter-boxes; G07B2017/00209 Mailbox, i.e. container for outgoing mail; G07B17/00193 Constructional details of apparatus in a franking system; A47G296/124 Appliances to prevent unauthorized removal of contents).

BACKGROUND OF THE PRESENT DISCLOSURE

Consumers are constantly using e-commerce and home delivery services to order products and goods online. Whether consumers order from large logistics fulfillment companies like Amazon or directly from retail stores or websites, many consumers prefer the ease and convenience of purchasing items that are delivered to their doorstep. In many neighborhoods, apartment complexes, and dwellings, it is not uncommon for one to see boxes and packages of various sizes on doorsteps, porches, and dwelling entrances. In some situations, packages are delivered to unattended locations. For example, delivery drivers may arrive at locations when a recipient is not present. Thus, the conventional strategy is to leave the packages at the doorstep for a recipient to retrieve at another time. This often causes problems because the conventional strategy does not account for theft of the package before a recipient arrives to retrieve the package. For example, a thief may steal the package immediately after the delivery driver leaves the location.

Accordingly, there remains a need for improved apparatus, system, and method of securing unattended packages left during package delivery. This need and other needs are satisfied by the various aspects of the present disclosure.

SUMMARY OF THE PRESENT DISCLOSURE

In accordance with the purposes of the present disclosure, as embodied and broadly described herein, the present disclosure, in one aspect, relates to an improved secured mailbox receptacle for unattended packages such as, for example a smart mailbox device. In further aspects, a smart mailbox device comprising at least one of a touch screen display, a doorbell notification system, a camera, a retractable bag, a retractable stretchable strip, a mailbox cover, a wall bracket, a fully motorized hidden axle, a motherboard, a WIFI transmitter/receiver, a GPS tracker, and other accessories.

In another aspect, the present disclosure relates to a smart mailbox device configured to receive mail and/or shipping packages. There is a demonstrated need for a smart mailbox device to secure packages delivered to homes or addresses when a recipient/owner is not present. In another aspect, the present disclosure relates to a secured system that prevents access to the delivered items from anyone other than a mail carrier and the recipient/owner of the items. In further aspects, the smart mailbox device may have an automated storage casing that can be released and retract automatically via an electronic mechanism. In another aspect, the smart mailbox device may alternatively have a manual release and retraction mechanism. In further aspects, the smart mailbox may be configured to engage as the mail carrier arrives within a proximity threshold. Upon approaching the proximity threshold, the smart mailbox device releases the retractable bag and retractable strip configured to accept a package inside.

The present disclosure generally relates to a secured mailbox system having a retractable bag. More specifically, a mounted mailbox system with a retractable bag or disposable bag attachment wherein the bag acts a secure receptacle for unattended packages. The mailbox system may interact with a GPS tracking device in the bag which may be configured to alert or send a beacon to an owner if the bag is removed or tampered with. The mailbox system may also incorporate a secure locking mechanism which may activated by a user interface (UI) attachment or user interface (UI) software application configured to open or close the receptacle compartment having the bag.

Specifically, the present disclosure requires at least the following functionality:

- Attachment of a secure mailbox apparatus to a wall, post, doorframe, etc. at an attachment point.
- Utilizing a secure code, user interface, or app to open or grant access to the secure mailbox apparatus.
- Dispensing a retractable bag securely fastened to the secure mailbox apparatus, the bag configured for accepting packages Sealing, securing, or locking the retractable bag via a locking mechanism after the package is placed inside. Bag may be constructed of tamper resistant, waterproof materials.

In further aspects, the present disclosure also relates to a smart mailbox device that may be small enough to be secured to any wall or mounting fixture. In yet further aspects, the smart mailbox device may be weatherproof and tamper resistant.

Additional aspects of the present disclosure will be set forth in part in the description which follows, and in part will be obvious from the description, or can be learned by practice of the present disclosure. The advantages of the present disclosure will be realized and attained by means of the elements and combinations particularly pointed out in the appended claims. It is to be understood that both the foregoing general description and the following detailed description are and explanatory only and are not restrictive of the present disclosure, as claimed.

BRIEF DESCRIPTION OF THE DRAWINGS

The accompanying drawings, which are incorporated in and constitute a part of this specification, illustrate several aspects of the present disclosure and together with the description, serve to explain the principles of the present disclosure.

DETAILED DESCRIPTION OF THE PRESENT DISCLOSURE

Figure 1:
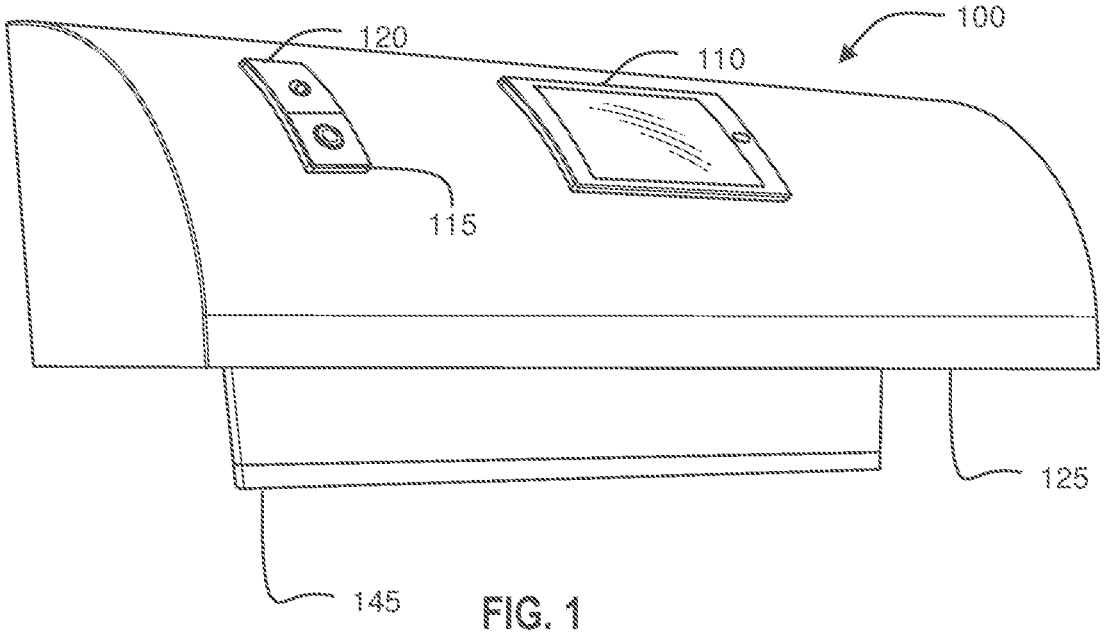
FIG. 1 shows a depiction of the smart mailbox device with a retractable bag in a retracted position, in accordance with an embodiment of the present disclosure.

The present disclosure can be understood more readily by reference to the following detailed description of the present disclosure and the examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present disclosure, example methods and materials are now described.

All publications mentioned herein are incorporated herein by reference to disclose and describe the methods and/or materials in connection with which the publications are cited.

Definitions

It is also to be understood that the terminology used herein is for the purpose of describing particular aspects only and is not intended to be limiting. As used in the specification and in the claims, the term "comprising" can include the aspects "consisting of" and "consisting essentially of." Unless defined otherwise, all technical and scientific terms used herein have the same meaning as commonly understood by one of ordinary skill in the art to which this present disclosure belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed devices, systems, and articles of the present disclosure as well as the devices themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the present disclosure. Thus, if there are a variety of additional steps that can be performed it is understood that each of these additional steps can be performed with any specific aspect or combination of aspects of the methods of the present disclosure.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

Smart Mailbox Devices and Systems

As briefly described above, the present disclosure relates, in various aspects, to a smart mailbox device having a retractable receptacle configured to receive at least one parcel. In one aspect, the present disclosure provides a smart mailbox device for receiving at least one package via retractable bag wherein the bag may be deformable, foldable, rollable, collapsible, and malleable. In further aspects, the smart mailbox device allowing for permanent attachment to a wall, bracket, or an anchor component. In still further aspects, the present disclosure provides a security system for receiving and securing unattended packages. In even further aspects, the present disclosure provides an apparatus for receiving and securing unattended packages. In yet even further aspects, the present disclosure provides a security and theft prevention system for unattended packages.

In accordance with the purposes of the present disclosure, as embodied and broadly described herein, the present disclosure, in one aspect, relates to an improved secured mailbox receptacle for unattended packages such as, for example a smart mailbox device. In further aspects, a smart mailbox device comprising at least one of a touch screen display, a doorbell notification system, a camera, a retractable bag, a retractable stretchable strip, a mailbox cover, a wall bracket, a fully motorized hidden axle, a motherboard, a WIFI transmitter/receiver, a GPS tracker, and other accessories.

In another aspect, the present disclosure relates to a smart mailbox device configured to receive mail and/or shipping packages. In yet another aspect, the present disclosure relates to a secured system that prevents access to the delivered items from anyone other than a mail carrier and the recipient/owner of the items. In further aspects, the smart mailbox device may have an automated storage casing that can be released and retract automatically via an electronic mechanism. In another aspect, the smart mailbox device may alternatively have a manual release and retraction mechanism. In further aspects, the smart mailbox may be configured to engage as the mail carrier arrives within a proximity threshold. Upon approaching the proximity threshold, the smart mailbox device releases the retractable back and/or retractable strip configured to accept a package inside.

The present disclosure provides a secured mailbox system having a retractable bag. More specifically, a mounted mailbox system with a retractable bag or disposable bag attachment wherein the bag acts a secure receptacle for unattended packages. The mailbox system may interact with a GPS tracking device in the bag which may be configured to alert or send a beacon to an owner if the bag is removed or tampered with. The mailbox system may also incorporate a secure locking mechanism which may activated by a user interface (UI) attachment or user interface (UI) software application configured to open or close the receptacle compartment having the bag.

Specifically, the present disclosure requires at least the following functionality:

- Attachment of a secure mailbox apparatus to a wall, post, doorframe, etc. at an attachment point.
- Utilizing a secure code, user interface, or app to open or grant access to the secure mailbox apparatus.
- Dispensing a retractable receptacle securely fastened to the secure mailbox apparatus, the receptacle configured for accepting packages. In one or more embodiments, the receptacle may comprise elastic or stretchable material configured to envelop a package.
- Sealing, securing, or locking the retractable receptacle via a locking mechanism after the package is placed inside. Bag may be constructed of tamper resistant, waterproof materials.

In further aspects, the present disclosure also relates to a smart mailbox device that may be small enough to be secured to any wall or mounting fixture. In yet further aspects, the smart mailbox device may be weatherproof and tamper resistant.

FIG. 1 shows a depiction of the smart mailbox device 100 in accordance with an embodiment of the present disclosure. In FIG. 1, the smart mailbox device 100 is depicted as it may appear when all components are assembled, and the device 100 is mounted and ready for use. In the illustrated example of FIG. 1, mainly exterior components of the smart mailbox device 100 are visible. As seen in the perspective view of FIG. 1, the smart mailbox device 100 can be comprised of a body 125, which is an elongated and rigid structure that serves as a mailbox housing and exterior body protecting the internal components of the device 100. Further, a touch screen user interface display 110, a smart doorbell notification interface 115, and a smart camera apparatus 120 can be installed on the body 125 in a manner that allows these components to be accessible on the exterior surface of the body 125. Also, as shown in FIG. 1, the smart mailbox device 100 can include a retractable bag 145. In one or more embodiments, the retractable bag 145 may be expandable, malleable, or have an elastic property to fit any items, packages, or contents deposited inside. Further, the retractable bag 145 may be secured to a surface including but not limited to a wall, a floor, a ground, and the likeness thereof. The retractable bag 145 may have a geometric shape and dimensions which allows it to cover, contain, hold, or secure packages or contents.

According to the embodiments, the retractable bag 145 is configured to perform automatic expandable and/or retractable motion. For instance, the retractable bag 145 can be automatically pushed down (e.g., in a vertical plane) to expand in an expandable motion, extending downward from the body 125 such that the retractable bag 145 is in an expanded position and can serve as a receptacle for safely holding a package that may be delivered to the smart mailbox device 100. According to the embodiments, the retractable bag is configured to automatically perform the expandable motion, for instance when the smart mailbox device 100 detects that a user is proximate (e.g., approaching) the device 100. When expanded, the retractable bag extends away from the body and into an expanded positioned to form a receptacle for receive at least one package. It should be appreciated that the manual interaction with the retractable bag 145 can also effectuate expandable and/or retractable motion. For example, a user can manually pull down the retractable bag 145 into the expanded position.

Alternatively, the retractable bag 145 can automatically perform a retractable motion, such that the bag 145 contracts moving back upwards (e.g., in a vertical plane) towards the body 125. The retractable bag 145 in a retracted position can be stored by the smart mailbox device 100 when not in use (e.g., not holding a package). For instance, the retractable bag 145 can automatically perform the retractable motion when the device 100 detects that a package has been removed from the retractable bag 145. FIG. 1 particularly shows an example of the smart mailbox device 100, where the retractable bag 145 is retracted into the retracted position. According to some embodiments, the retractable bag 1345 can be constructed from a tamper resistant material, a waterproof material, an anti-theft material, a lock, an alarm, an electrical shock, and other security accessories.

Figure 13:
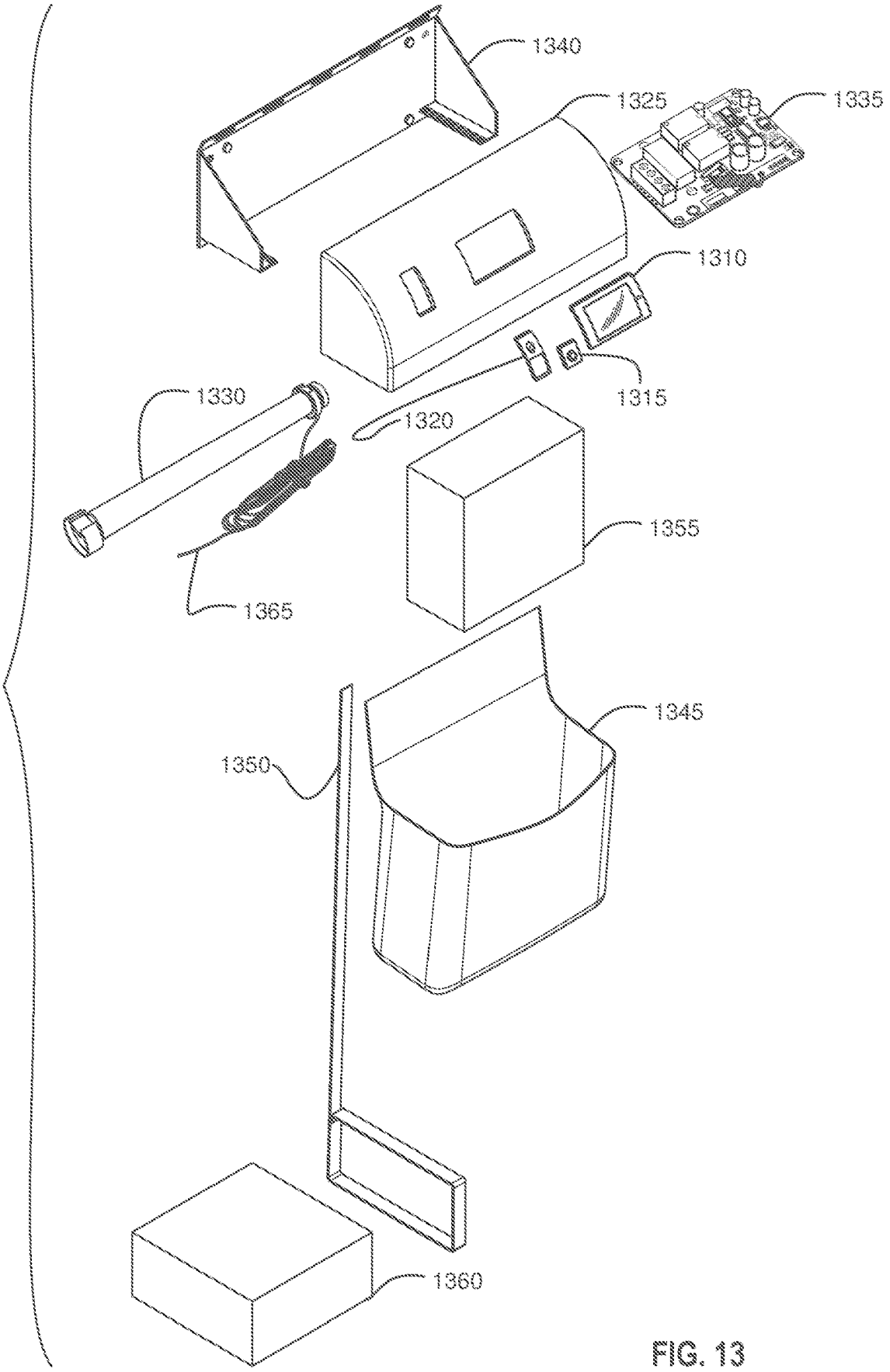
FIG. 13 depicts an exploded view of the smart box device, in accordance with an embodiment of the present disclosure.

In order to describe the components of the smart mailbox device in detail, reference is made to FIG. 13. Referring now to FIG. 13, an exploded view of the smart mailbox device 1300 is depicted, which prominently illustrates each of the components (e.g., internal, and external) that can comprise the smart mailbox device 1300, according to an embodiment. As seen in FIG. 13, the smart mailbox device 1300 can comprise: the body 1325; the touch screen user interface display 1310; the smart doorbell notification interface 1315; the smart camera apparatus 1320; an axle member 1330 including a wire 1365, wherein the axle member 1330 effectuates the expandable motion and the retractable motion of the device 1300 and can be at least one of: a manual axle, a motorized axle, and an automated motorized axle; a computing device 1335, shown as an integrated circuit (e.g., motherboard or printed circuit board) having circuitry that provides the capabilities including at least of: wireless communication, detecting a proximate user (e.g., proximity detection), location tracking, cloud computing, remote access, device management, and computing functions; a secure attachment member 1340; the retractable bag 145 configured to: retract a receptacle as a package carrier approaches the smart mailbox device 100, receive at least one package 1355, secure the at least one package 1355; and a retractable strip 1350, wherein the retractable strip 1350 is an elongated piece of material which can be attached to another package 1360 at a distal end and attached to the body 1325 at the opposing end, and configured to: retract as a package carrier approaches the smart mailbox device, wrap around the perimeter of the second package 1360 (which may be larger than the package 1355 stored in the retractable bag 1345) to anchor and/or secure the package 1360 to the smart mailbox device 100. According to the embodiments, the retractable strip 1350 has a geometric shape and dimensions which it to wrap around the perimeter (e.g., area) of second package 1360. Further, the retractable strip 1350 can perform the automatic expandable motion and the retractable motion, in the same manner as the retractable bag 1345 as described above.

The secure attachment member 1340 can include: a wall bracket; an anchor; a pillar; a post; a welded member; a brace; and a wall attachment, which allows the secure attachment member 1340 to function as an attachment means used for securely and fixedly affixing the smart mailbox device 1300 to a stationary surface, such as a wall or floor. It should be appreciated that other retractable members may be used in addition to, or in lieu of the retractable bag 1345 and the retractable strip 1350. These other forms of retractable members can be implemented as at least one of: a receptacle, a bag, a band, a chain, a rope, a wire, a case, a box, a container, and a receiving apparatus. It should be understood that in cases where the smart mailbox device 1300 may be secured or adhered to a floor (as opposed to a wall) the retractable bag 1345 and the retractable strip 1350 may be described as expanding in an outward direction and retracting in an inward direction.

Figure 2:
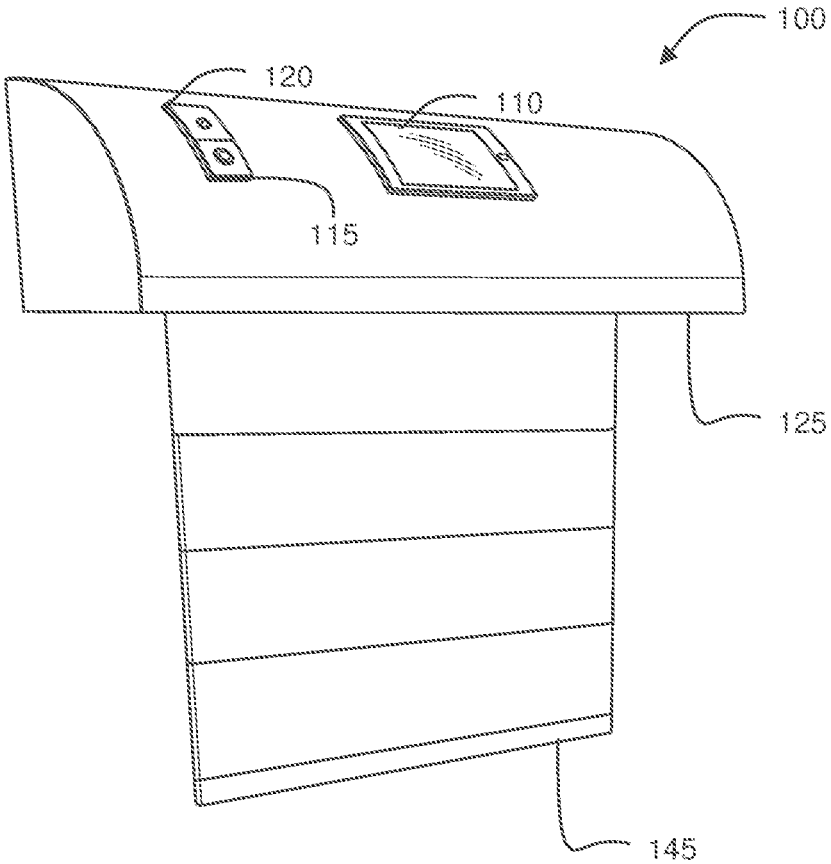
FIG. 2 shows a depiction of a smart mailbox device with the retractable bag in an expanded position, in accordance with an embodiment of the present disclosure.

FIG. 2 depicts another view of the smart mailbox device 100. FIG. 2 particularly shows an example of the smart mailbox device 100, where the retractable bag 145 is extended into the expanded position. In the arrangement of FIG. 2 with the retractable bag 145 expanded, the smart mailbox device 100 can serve as a receptacle for safely holding a package that may be delivered to the smart mailbox device 100 in an operation.

Figure 3:
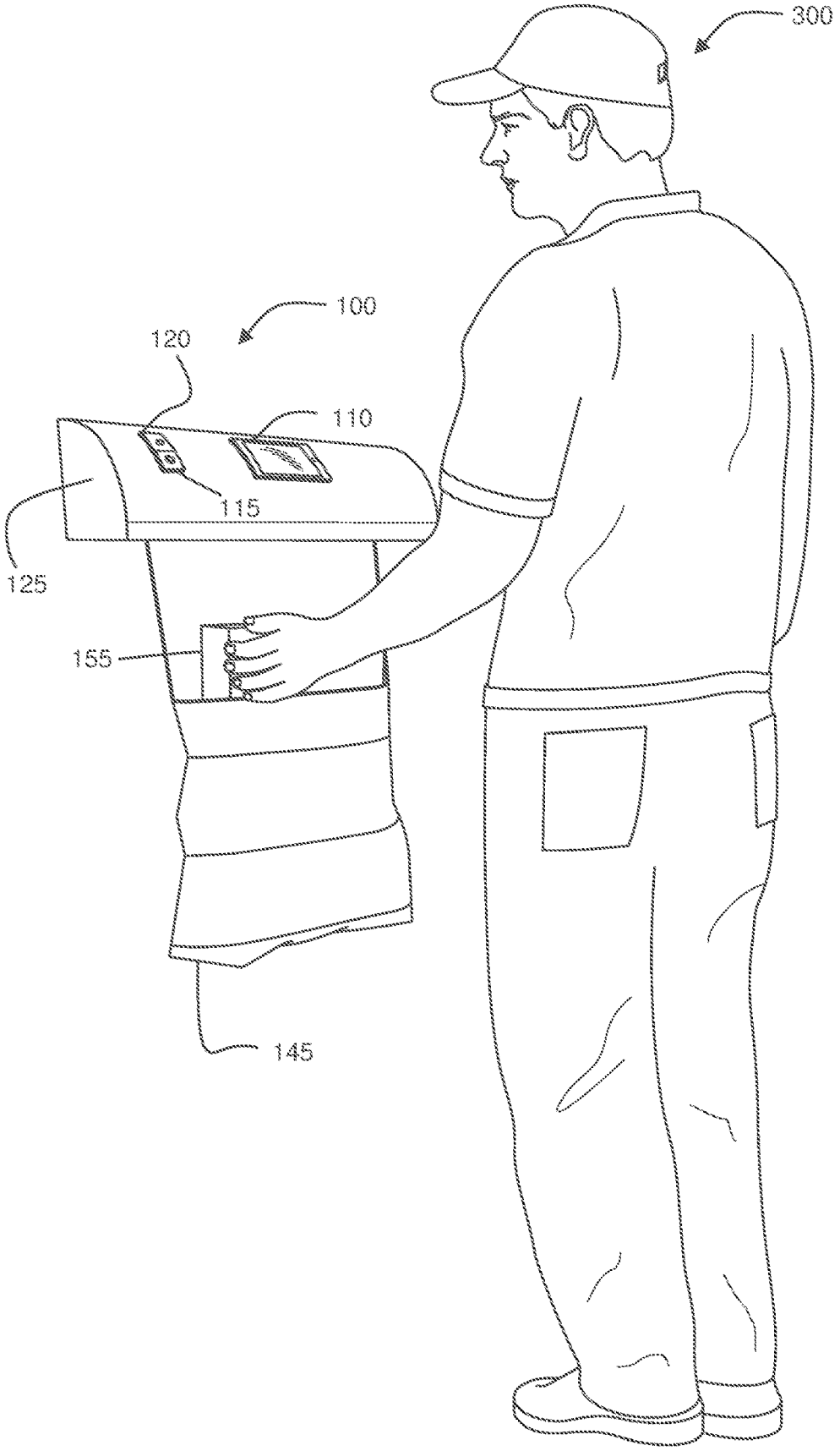
FIG. 3 depicts the smart mailbox device in an operational example of receiving a package in the retractable bag, in accordance with an embodiment of the present disclosure.

FIG. 3 depicts the smart mailbox device 100 in an example operational use. Particularly in FIG. 3, the smart mailbox device 100 is arranged with its retractable bag 145 in the expanded position. A human user 300, for instance a parcel worker, delivering a package 155 can insert the package 155 into the retractable bag 145 while in its expanded position. For purposes of illustration, the package 155 is shown as a box (e.g., cardboard box). However, it should be appreciated that the package 155 can be in other forms, not limited to a box, that are suitable for delivery. Thus, the smart mailbox device 100 can securely hold the package 155 after delivery by the user 300 until it is retrieved (e.g., by an owner of the package 155).

Figure 4:
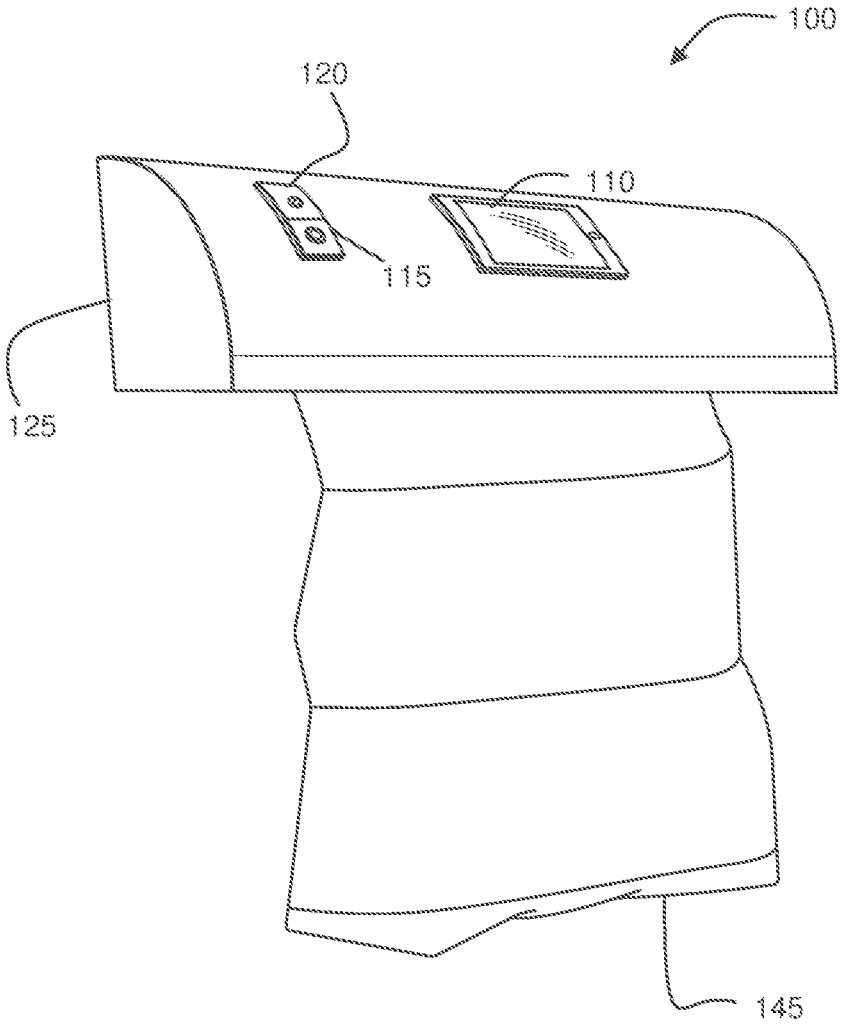
FIG. 4 depicts a perspective view of the smart mailbox device, in accordance with an embodiment of the present disclosure.

FIG. 4 shows a perspective view of the smart mailbox device 100 in accordance with an embodiment of the present disclosure. Again, in FIG. 4, the smart mailbox 100 is shown where the retractable bag 145 is extended into the expanded position.

Figure 5:
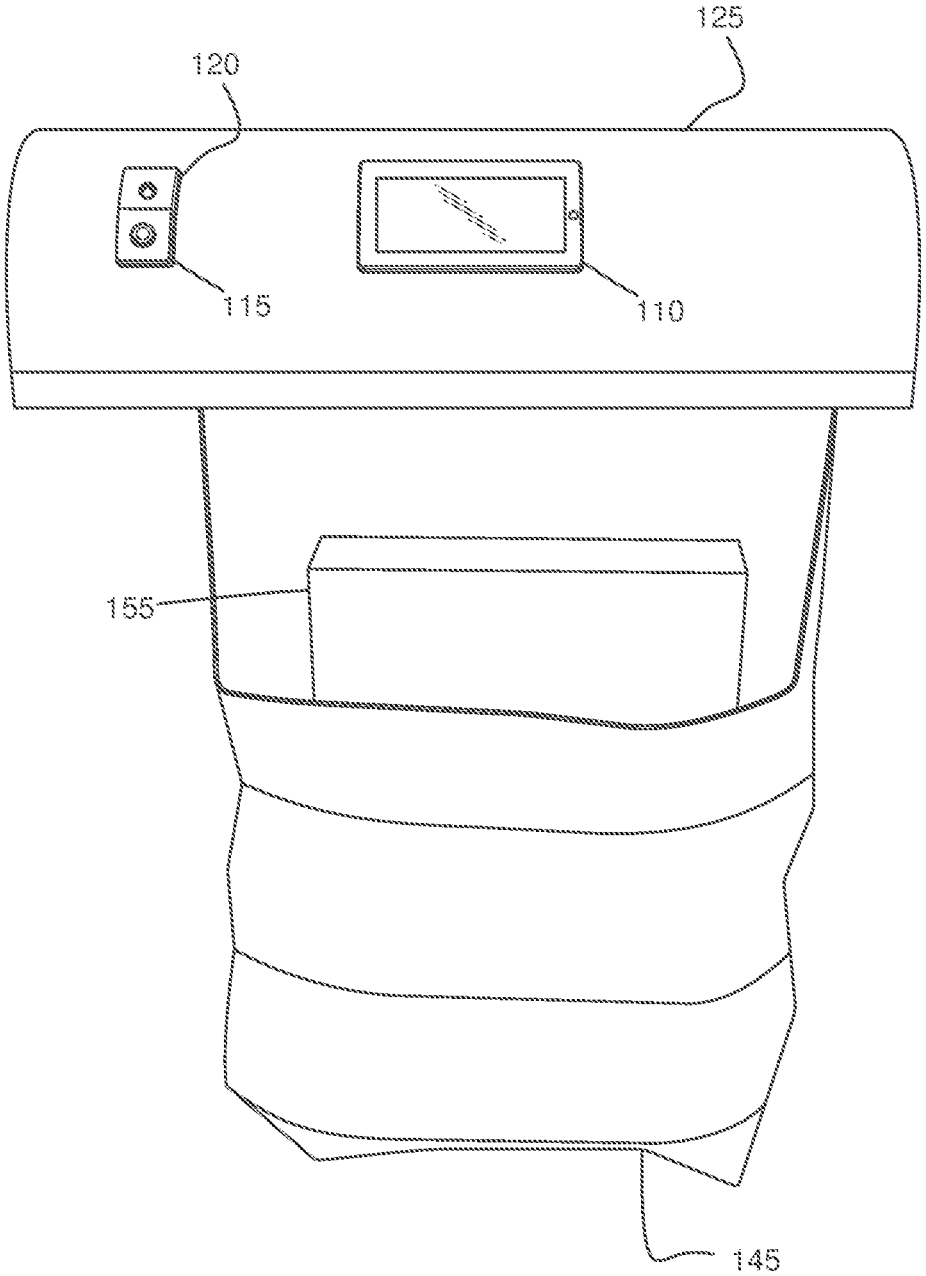
FIG. 5 depicts a front view of the smart box device in an operation example of holding a package in the retractable bag, in accordance with an embodiment of the present disclosure.

FIG. 5 shows a front view of the smart mailbox device 100 in accordance with an embodiment of the present disclosure. FIG. 5 particularly illustrates the smart mailbox 100 with a package 155 securely stored within the retractable bag 145 (in the expanded position).

Figure 6:
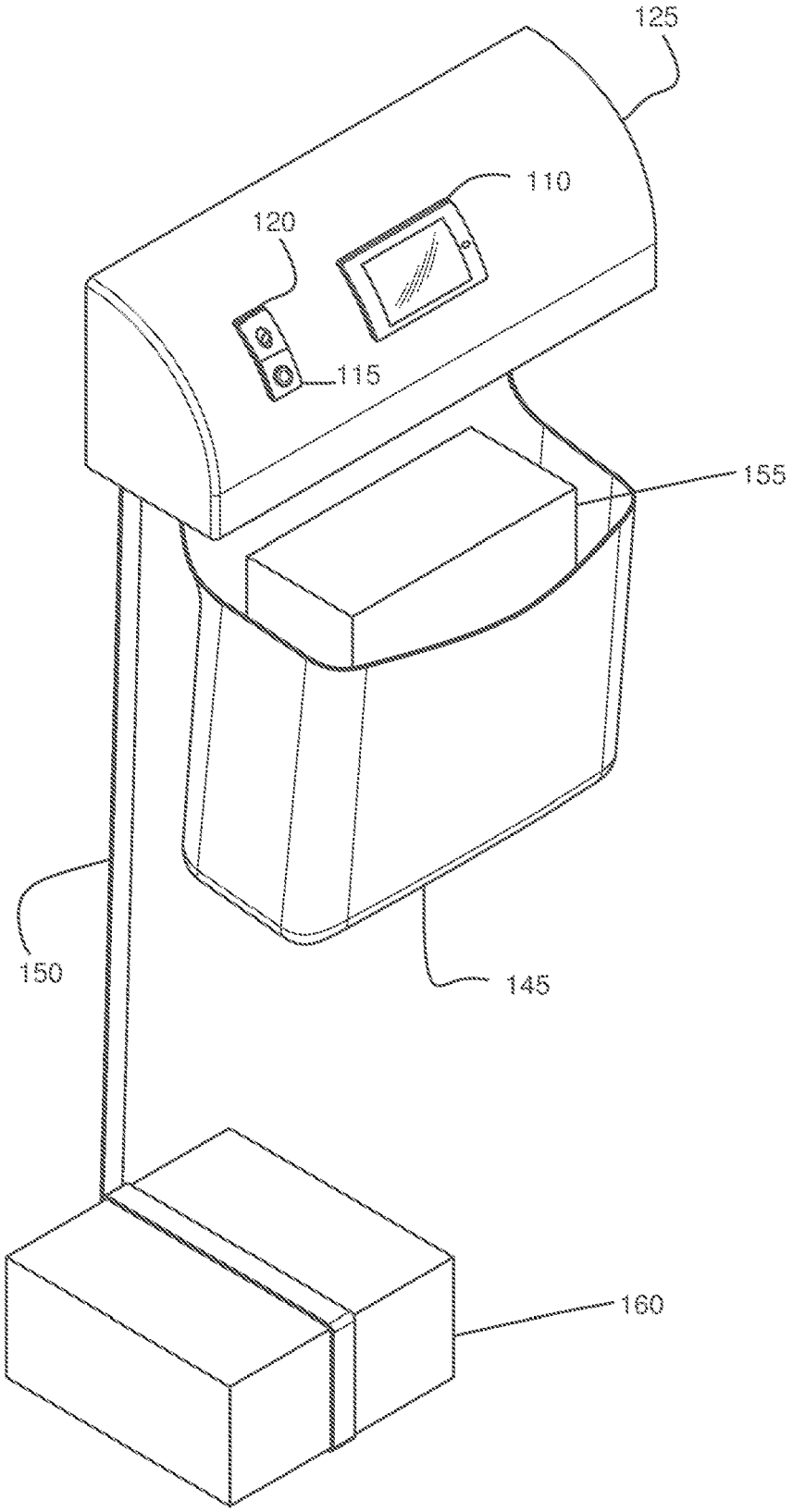
FIG. 6 depicts a perspective view of the smart box device in an operation example of holding a package in the retractable bag and a retractable strip attached to another package, in accordance with an embodiment of the present disclosure.

FIG. 6 shows a perspective view the smart mailbox 100 in another operational use. In detail, FIG. 6 illustrates an example of the smart mailbox 100 where the retractable bag 145 and the retractable strip 150 are both in use. In the illustrated example, a package 155 is securely stored within the retractable bag 145. Another package 160 is securely anchored to the smart mailbox device 100, having the retractable strip 150 expanded and wrapped around the perimeter of the package 160. As a general description, the retractable strip 150 may be optimal for use with larger packages, for instance large boxes having dimensions that are too large to fit securely inside of the retractable bag 145 of the smart mailbox device 100.

Figure 7:
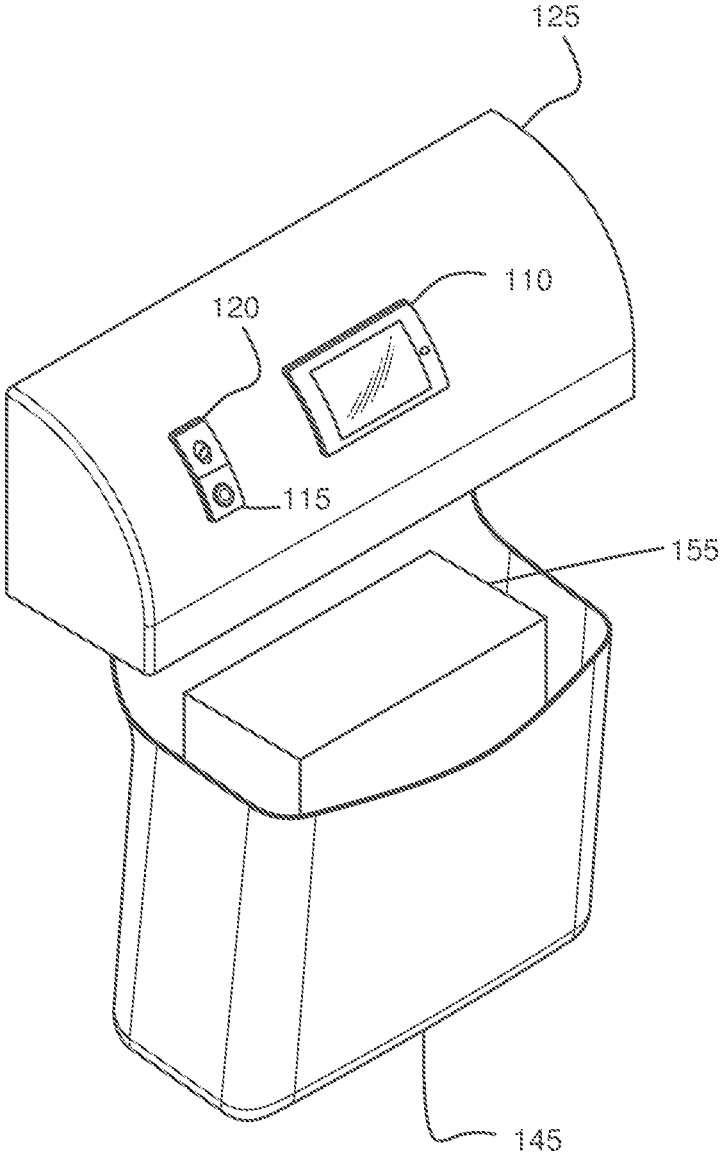
FIG. 7 depicts a perspective view of the smart box device in an operation example of holding a package in the retractable bag, in accordance with an embodiment of the present disclosure.

FIG. 7 shows a perspective view of the smart mailbox device 100 in accordance with an embodiment of the present disclosure. FIG. 7 particularly illustrates the smart mailbox 100 with the package 155 securely stored within the retractable bag 145 (in the expanded position).

Figure 8:
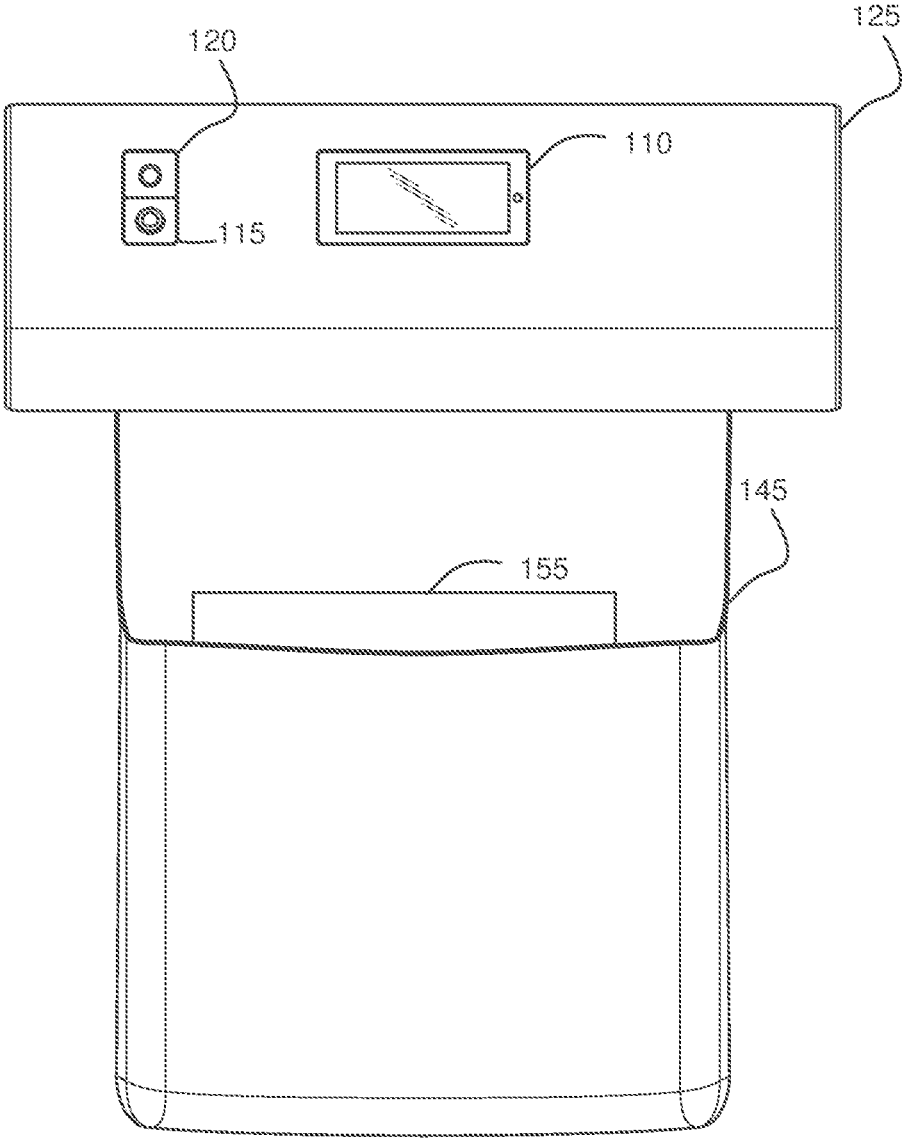
FIG. 8 depicts a front elevation view of the smart box device in an operation example of holding a package in the retractable bag, in accordance with an embodiment of the present disclosure.

In FIG. 8, another front view of the smart mailbox device 100 is depicted, in accordance with an embodiment of the present disclosure. FIG. 8 also shows the smart mailbox 100 with the package 155 securely stored within the retractable bag 145 (in the expanded position).

Figure 9:
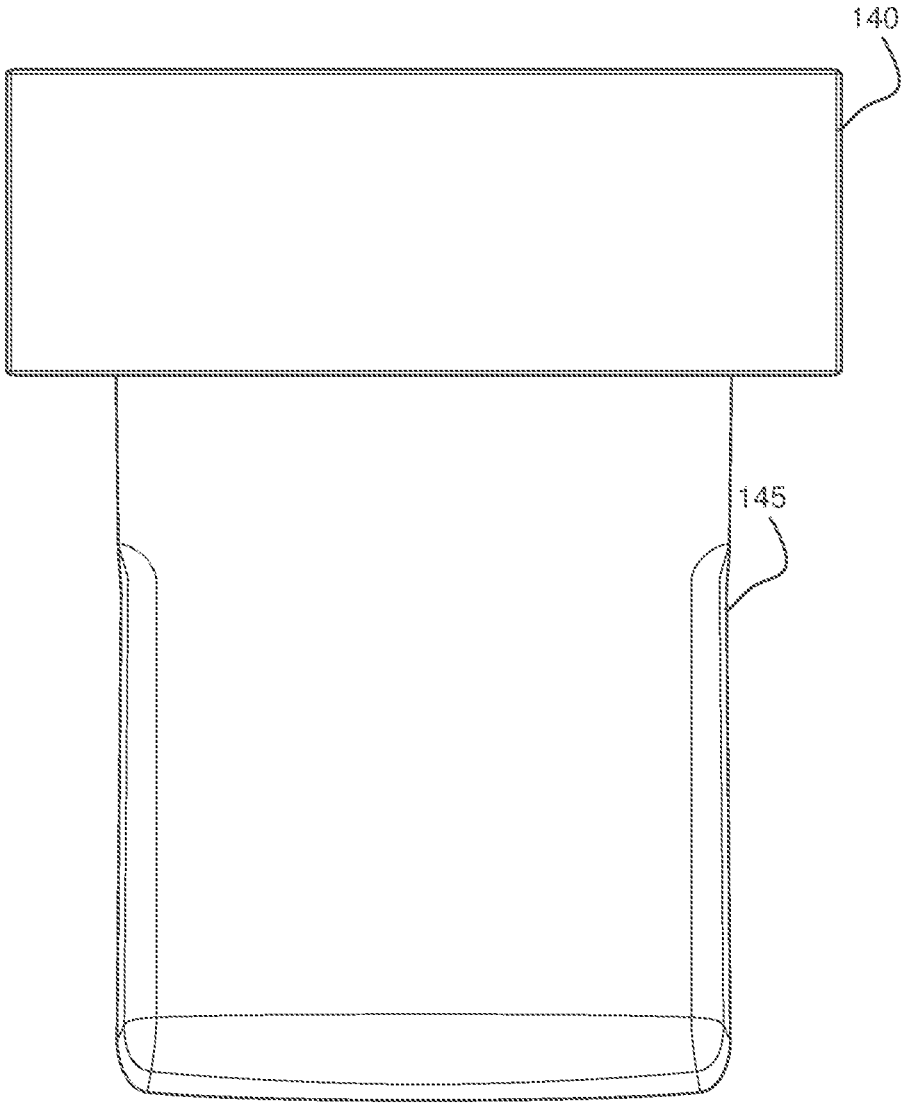
FIG. 9 depicts a rear elevation view of the smart box device in an operation example of holding a package in the retractable bag, in accordance with an embodiment of the present disclosure.

A back view of the smart mailbox device 100 is depicted in FIG. 9, in accordance with an embodiment of the present disclosure. Thus, FIG. 9 prominently illustrates the back (or rear) surface of the device 100, where the secure attachment member 140 can be arranged. The retractable bag 145 in the expanded position is also visible in the back view of smart mailbox device 100 shown in FIG. 9.

Figure 10:
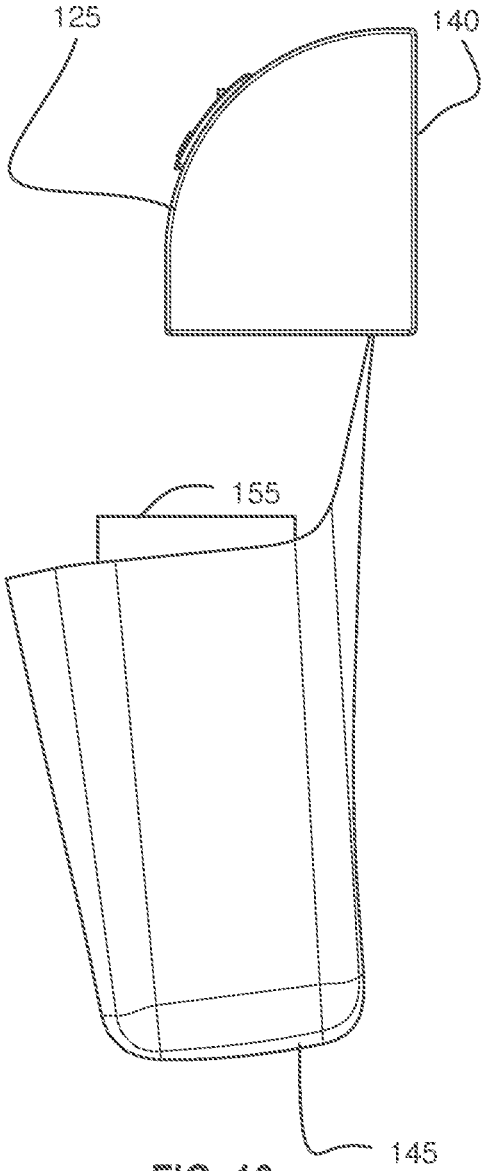
FIG. 10 depicts a side view of the smart box device in an operation example of holding a package in the retractable bag, in accordance with an embodiment of the present disclosure.

In FIG. 10, a side view of the smart mailbox device 100 is depicted, in accordance with an embodiment of the present disclosure. FIG. 9 also shows the smart mailbox 100 with the package 155 securely stored within the retractable bag 145 (in the expanded position).

Figure 11:
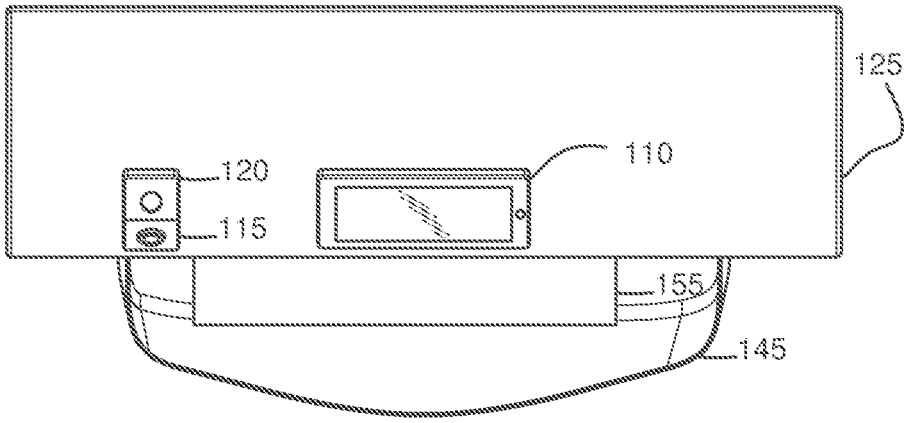
FIG. 11 depicts a top plan view of the smart box device in an operation example of holding a package in the retractable bag, in accordance with an embodiment of the present disclosure.

FIG. 11 illustrates a top view of the smart mailbox device 100, in accordance with an embodiment of the present disclosure. FIG. 11 also shows the smart mailbox 100 with the package 155 securely stored within the retractable bag 145 (in the expanded position).

FIG. 11 illustrates a top view of the smart mailbox device 100, in accordance with an embodiment of the present disclosure. FIG. 11 also shows the smart mailbox 100 with the package 155 securely stored within the retractable bag 145 (in the expanded position).

Figure 12:
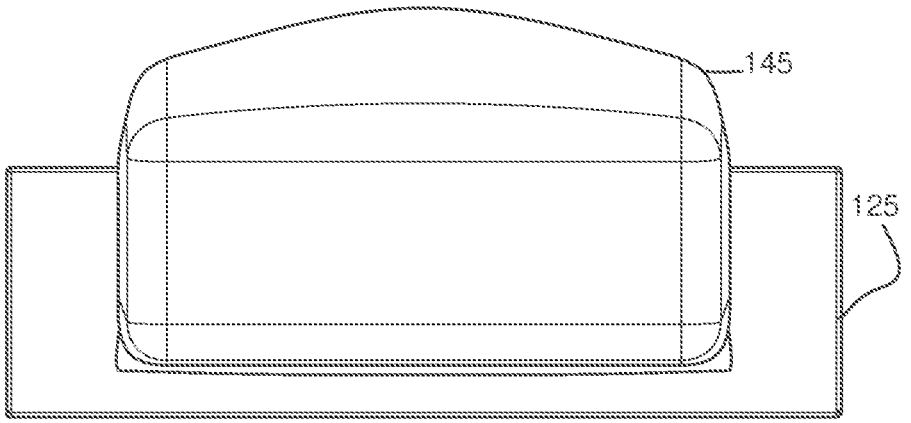
FIG. 12 depicts a bottom plan view of the smart box device in an operation example of holding a package in the retractable bag, in accordance with an embodiment of the present disclosure.

FIG. 12 illustrates a bottom view of the smart mailbox device 100, in accordance with an embodiment of the present disclosure.

In various aspects, the apparatuses and systems represented in any of these figures may comprise one or more varieties or combinations of the one or more elements, components, members, devices, and apparatuses. Any such variations are well within the scope of the present disclosure.

Methods for Using the Devices and Systems

The present disclosure, according to further aspects, also provides methods of using the disclosed devices and systems. In one aspect, disclosed herein is a method for receiving, securing, and delivering unattended packages using a smart mailbox device. In one or more aspects, the present disclosure may provide: a method for securing and receiving packages utilizing a smart mailbox device, the method comprising: activating a smart mailbox device, upon approach of a package carrier; authenticating the package carrier; opening a retractable apparatus; receiving, by the retractable apparatus, at least one package; securing, by the retractable apparatus, the at least one package; and notifying, by a notification system of the smart mailbox device, an intended recipient of delivery of the at least one package.

In one or more aspects, the present disclosure may further provide: a method further comprising: activating a smart mailbox device, upon approach of a user; authenticating the user; opening a retractable apparatus; retrieving, by the user, the at least one package; securing, by the retractable apparatus, the smart mailbox device; and notifying, by a notification system of the smart mailbox device, an intended recipient of retrieval of the at least one package by the user.

Figure 14:
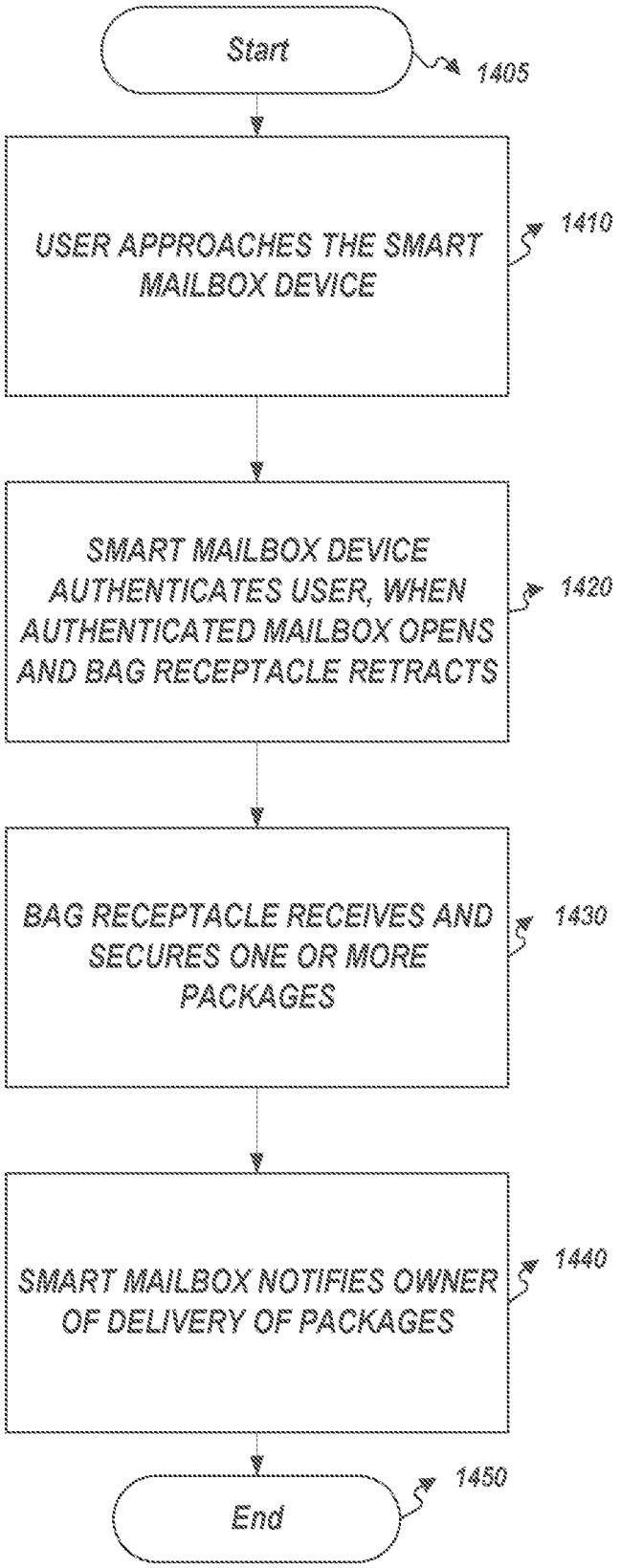
FIG. 14 shows a method of using a smart mailbox device in accordance with an embodiment of the present disclosure.

FIG. 14 is a flow chart setting forth the general stages involved in a method 1400 consistent with an embodiment of the disclosure for providing a smart mailbox system (shown in FIG. 1-FIG. 13). Method 1400 may be implemented using the smart mailbox device or a computing device. For example, different operations may be performed by different networked elements in operative communication with a computing device, where the computing device may be employed in the performance of some or all of the stages in method 1400.

Although method 1400 has been described to be performed by computing device 1400, it should be understood that, in some embodiments, Although the stages illustrated by the flow charts are disclosed in a particular order, it should be understood that the order is disclosed for illustrative purposes only. Stages may be combined, separated, reordered, and various intermediary stages may exist. Accordingly, it should be understood that the various stages illustrated within the flow chart may be, in various embodiments, performed in arrangements that differ from the ones illustrated. Moreover, various stages may be added or removed from the flow charts without altering or deterring from the fundamental scope of the depicted methods and systems disclosed herein. Ways to implement the stages of method 1400 will be described in greater detail below.

Method 1400 may begin at starting block 1405 and proceed to stage 1410 where a smart mailbox device may be activated by a user approaching by one or more means including but not limited to receiving a notification for a server, a mobile application, a delivery service; an object or user crossing a proximity threshold, boundary, or sensor radius; when a camera reader reads a symbol, QR code, label, stamp, or the like. For example, the smart mailbox device activating a user interface once a delivery man approaches after a camera reads a FedEx® symbol on a delivery man.

From stage 1404, where smart mailbox device activates upon the approach of a package, method 1400 may advance to stage 1420 where smart mailbox device may authenticate the parcel delivery worker. Upon successful authentication, smart mailbox device opens receiving compartments including a retractable bag receptacle. For example, retracting a package receptacle bag upon the delivery worker being authenticated.

Once smart mailbox device authenticated the parcel delivery worker and opens receiving compartments in stage 1420, method 1400 may continue to stage 1430 where smart mailbox device may receive and secure one or more packages. For example, the smart mailbox device receiving one smaller package in a retractable bag parcel receptacle and a larger package via a retractable tamper resistant stretchable band configured to secure larger packages.

After smart mailbox device receives and secures one or more packages in stage 1430, method 1400 may proceed to stage 1440 where smart mailbox device may notify an intended recipient and/or owner of the successful delivery of packages. For example, a text message, mobile application notification, phone call, or other notification may be delivered to the intended recipient and/or owner upon completion of the successful delivery. Alternatively, notification could be selectively adapted by user preference to notify at each step of the process. Furthermore, the notification could be selectively adapted to include recording the entire delivery. Even further, the notification could be further selectively adapted to record, live stream, or provide real-time uploading to a cloud or streaming service any attempted theft, tampering, removal, or other activity. Once smart mailbox device notifies an intended recipient and/or owner of the successful delivery of packages in stage 1440, method 1400 may then end at stage 1450. Alternatively, method 1400 could continue starting over at 1410 when an intended recipient and/or owner of the packages approaches the smart mailbox device. Instead of simply authenticating and opening to receive/secure packages as described in stage 1420 and stage 1430, the smart mailbox device 100 may simply authenticate the intended recipient/owner of the packages and release them to allow package retrieval prior to returning to a secured starting position.

Smart Mailbox Device Platform Architecture

The smart mailbox device may further include components and/or be in communication with or utilize the computer device architecture and technology of, for example, but not be limited to, a website, a web application, a desktop application, and a mobile application compatible with a computing device. The computing device may comprise, but not be limited to, a desktop computer, laptop, a tablet, or mobile telecommunications device. Moreover, smart mailbox device 100 may further include components and/or be in communication with or may be hosted on a centralized server, such as, for example, a cloud computing service. Although method (shown in FIG. 14) has been described to be performed by a smart mailbox device, it should be understood that, in some embodiments, different operations may be performed by different networked elements in operative communication with smart mailbox device.

Embodiments of the present disclosure may comprise a system having a memory storage and a processing unit. The processing unit coupled to the memory storage, wherein the processing unit is configured to perform the stages of the previously described method.

Figure 15:
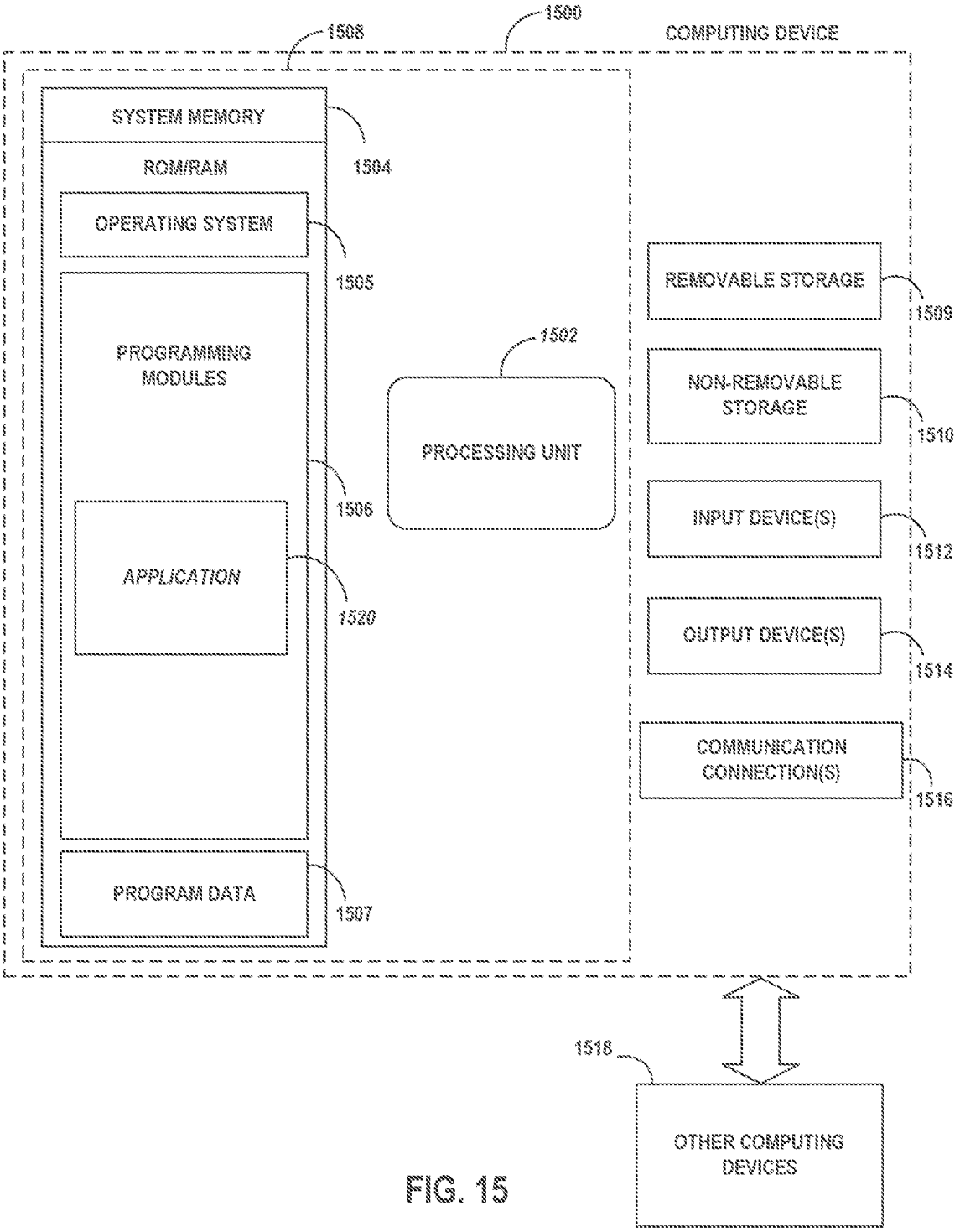
FIG. 15 is a block diagram of a system including a computing device, in accordance with an embodiment of the present disclosure.

FIG. 15 is a block diagram of a system including computing device 1500. Consistent with an embodiment of the disclosure, the aforementioned memory storage and processing unit may be implemented in a computing device, such as computing device 1500 of FIG. 15. Any suitable combination of hardware, software, or firmware may be used to implement the memory storage and processing unit. For example, the memory storage and processing unit may be implemented with computing device 1500 or any of other computing devices 1518, in combination with computing device 1500. The aforementioned system, device, and processors are examples and other systems, devices, and processors may comprise the aforementioned memory storage and processing unit, consistent with embodiments of the disclosure.

With reference to FIG. 15, a system consistent with an embodiment of the disclosure may include a computing device, such as computing device 1500. In a basic configuration, computing device 1500 may include at least one processing unit 1502 and a system memory 1504. Depending on the configuration and type of computing device, system memory 1504 may comprise, but is not limited to, volatile (e.g., random-access memory (RAM)), non-volatile (e.g., read-only memory (ROM)), flash memory, or any combination. System memory 1504 may include operating system 1505, one or more programming modules 1506, and may include a program data 1507. Operating system 1505, for example, may be suitable for controlling computing device's 1500 operation. In one embodiment, programming modules 1506 may include a smart mailbox application 1520. Furthermore, embodiments of the disclosure may be practiced in conjunction with a graphics library, other operating systems, or any other application program and is not limited to any particular application or system. This basic configuration is illustrated in FIG. 15 by those components within a dashed line 1508.

Computing device 1500 may have additional features or functionality. For example, computing device 1500 may also include additional data storage devices (removable and/or non-removable) such as, for example, magnetic disks, optical disks, or tape. Such additional storage is illustrated in FIG. 15 by a removable storage 1509 and a non-removable storage 1510. Computer storage media may include volatile and nonvolatile, removable, and non-removable media implemented in any method or technology for storage of information, such as computer readable instructions, data structures, program modules, or other data. System memory 1504, removable storage 1509, and non-removable storage

1510 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information, and which can be accessed by computing device 1500. Any such computer storage media may be part of device 1500. Computing device 1500 may also have input device(s) 1512 such as a keyboard, a mouse, a pen, a sound input device, a touch input device, etc. Output device(s) 1514 such as a display, speakers, a printer, etc. may also be included. The aforementioned devices are examples and others may be used.

Computing device 1500 may also contain a communication connection 1516 that may allow device 1500 to communicate with other computing devices 1518, such as over a network in a distributed computing environment, for example, an intranet or the Internet. Communication connection 1516 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both storage media and communication media.

As stated above, a number of program modules and data files may be stored in system memory 1504, including operating system 1505. While executing on processing unit 1502, programming modules 1506 (e.g., smart mailbox application 1520) may perform processes including, for example, one or more of method's stages as described above. The aforementioned process is an example, and processing unit 1502 may perform other processes. Other programming modules that may be used in accordance with embodiments of the present disclosure may include electronic mail and contacts applications, word processing applications, spreadsheet applications, database applications, slide presentation applications, drawing or computer-aided application programs, etc.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, multiprocessor systems, microprocessor-based or programmable consumer electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general-purpose computer or in any other circuits or systems.

Embodiments of the disclosure, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random-access memory (RAM), a read-only memory (ROM), an erasable programmable read-only memory (EPROM or Flash memory), an optical fiber, and quantum computing elements. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, solid state storage (e.g., USB drive), or a CD-ROM, a carrier wave from the Internet, or other forms of RAM or ROM. Further, the disclosed methods' stages may be modified in any manner, including by reordering stages and/or inserting or deleting stages, without departing from the disclosure.

Throughout this application, various publications can be referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present disclosure is not entitled to antedate such publication by virtue of prior present disclosure. Further, the dates of publication provided herein can be different from the actual publication dates, which can require independent confirmation.

The patentable scope of the present disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

Although very narrow claims are presented herein, it should be recognized the scope of this disclosure is much broader than presented by the claims. It is intended that broader claims will be submitted in an application that claims the benefit of priority from this application.

Aspects

The following disclose various Aspects of the present disclosure. The various Aspects are not to be construed as patent claims unless the language of the Aspect appears as a patent claim. The Aspects describe various non-limiting embodiments of the present disclosure.

Aspect 1. A smart mailbox device comprising:
a touch screen user interface display;
a smart doorbell notification interface;
a smart camera apparatus;
an axle member;
a computing device having capabilities including at least one of: wireless communication, location tracking, cloud computing, remote access, device management, and computing functions;
a secure attachment member;
a retractable bag configured to:
retract a receptacle as a package carrier approaches the smart mailbox device,
receive at least one package,
secure the at least one package; and
a retractable security band configured to:
retract for attachment to the at least one package above a retractable bag threshold size,
adhere and secure to the at least one package above a retractable bag threshold size.

Aspect 2. A smart security device comprising:
a touch screen user interface display;
a smart doorbell notification interface;
a smart camera apparatus;
an axle member wherein the axle member is at least one of: a manual axle, a motorized axle, and an automated motorized axle;
a computing device having capabilities including at least one of: wireless communication, location tracking, cloud computing, remote access, device management, and computing functions;
a secure attachment member; and
a retractable member configured to:
retract a receptacle as a package carrier approaches the smart mailbox device,
receive at least one package,
secure the at least one package.

Aspect 3. The smart security device of Aspect 2, wherein the secure attachment member comprises at least one of a wall bracket, an anchor, a pillar, a post, a welded member, a brace, and a wall attachment.

Aspect 4. The smart security device of Aspect 2, wherein the retractable member further comprises at least one of: a receptacle, a bag, a band, a chain, a rope, a wire, a case, a box, a container, and a receiving apparatus.

Aspect 5. The smart security device of Aspect 2, wherein the retractable member further comprises at least one of: a tamper resistant material, a waterproof material, an anti-theft material, a lock, an alarm, an electrical shock, and security accessories.

Aspect 6. A smart mailbox package security system comprising:
a user interface component;
a smart doorbell component;
a smart camera component;
a retractable receptacle apparatus having an axle member and retractable member;
a computing system having capabilities including at least one of: wireless communication, location tracking, cloud computing, remote access, device management, and computing functions;
a secure attachment component having an anchor member and an attachment element; and
a securing component for securing one or more packages.

Aspect 7. The smart mailbox package security system of Aspect 6, wherein the retractable receptacle apparatus further comprises at least one of: a receptacle, a bag, a band, a chain, a rope, a wire, a case, a box, a container, and a receiving apparatus.

Aspect 8. A method for securing and receiving packages utilizing a smart mailbox device, the method comprising:
activating a smart mailbox device, upon approach of a package carrier;
authenticating the package carrier;
opening a retractable apparatus;
receiving, by the retractable apparatus, at least one package;
securing, by the retractable apparatus, the at least one package; and notifying, by a notification system of the smart mailbox device, an intended recipient of delivery of the at least one package.

Aspect 9. A method of claim 17, the method further comprising:

activating a smart mailbox device, upon approach of a user;

authenticating the user;

opening a retractable apparatus;

retrieving, by the user, the at least one package;

securing, by the retractable apparatus, the smart mailbox device; and notifying, by a notification system of the smart mailbox device, an intended recipient of retrieval of the at least one package by the user.

What is claimed:

1. A smart mailbox device comprising:

a body, wherein the body is affixed to a surface;

wherein the body houses:

an axle, wherein the axle effectuates an expandable motion and a retractable motion;

a computer device, wherein the computer device has capabilities including at least one of: proximity detection, wireless communication, location tracking, cloud computing, remote access, device management, and computing functions; and a retractable bag coupled to the body, wherein the retractable bag: automatically performs the expandable motion such that the retractable bag extends away from the body and into an expanded positioned to form a receptacle for receive at least one package upon detection, by the computer device, of a user being proximately located.

2. The smart mailbox device of claim 1, wherein the retractable bag automatically performs the retractable motion such that the retractable bag contracts towards the body and into a retracted position.

3. The smart mailbox device of claim 2, wherein the retractable bag automatically performs the retractable motion upon detection, by the computer device, of the at least one package being removed from the retractable bag.

4. The smart mailbox device of claim 3, wherein the retractable bag in response to interaction additionally performs at least one of:

expanding in the expandable motion, and retracting in the retractable motion.

5. The smart mailbox device of claim 1, wherein the retractable bag comprises having a geometric shape and proportions configured to receive, cover, hold, encircle, and secure the at least one package.

6. The smart mailbox device of claim 1, wherein the retractable bag comprises one or more of: a tamper resistant material, a waterproof material, an anti-theft material, a lock, an alarm, an electrical shock, and security accessory.

7. The smart mailbox device of claim 1, further comprising:

a secure attachment member installed on a body attachment, wherein the secure attachment member securely and fixedly affixes the body to the surface.

8. The smart mailbox device of claim 7, wherein the secure attachment member comprises at least one of: a wall bracket, an anchor, a pillar, a post, a welded member; a brace, and a wall attachment.

9. The smart mailbox device of claim 1, wherein the axle comprises at least one of a manual axle, a motorized axle, and an automated motorized axle.

10. The smart mailbox device of claim 1, further comprising:

a touch screen user interface display installed on the body;

a smart doorbell notification interface installed on the body; and a smart camera apparatus installed on the body.

11. An apparatus comprising:

a body, wherein the body is affixed to a surface;

wherein the body houses:

a mechanism, wherein the mechanism effectuates a motion wherein the motion is at least one of an expandable motion and a retractable motion;

a computer device operably connected to the mechanism, wherein the computer device has capabilities including at least one of: proximity detection, wireless communication, location tracking, cloud computing, remote access, device management, and computing functions;

a retractable bag coupled to the body, wherein the retractable bag:

automatically performs the motion, using the mechanism, such that the retractable bag extends away from the body and into an expanded position to form a receptacle for receiving at least one package; and a retractable strip coupled to the body, wherein the retractable strip automatically performs the motion, using the mechanism, such that the retractable strip moves from a first position to a second position, wherein the second position is configured to anchor at least one additional package to the body.

12. The apparatus of claim 11, wherein the retractable strip comprises an elongated member which can be attached to the at least one additional package at a distal end and attached to the body at the opposing end.

13. The apparatus of claim 12, wherein the retractable strip comprises a geometric shape and dimensions to wrap around a perimeter of the at least one additional package to anchor the at least one additional package to the body.

14. The apparatus of claim 11, wherein the retractable bag automatically performs the expandable motion upon detection upon detection of a user, by the computing device, being proximately located.

15. The apparatus of claim 11, wherein the retractable strip automatically performs the expandable motion upon detection upon detection of a user, by the computing device, being proximately located.

16. The apparatus of claim 11, wherein the retractable bag automatically performs the retractable motion upon detection, by the computing device, of the at least one package being removed from the retractable bag.

17. The apparatus of claim 11, wherein the retractable strip automatically performs the retractable motion upon detection, by the computing device, of the at least one additional package being removed.

18. A method of using the apparatus of claim 11, the method comprising:

activating the apparatus, upon approach of a user;

authenticating the user;

opening a retractable portion, wherein the retractable portion is at least one of the retractable bag coupled to the body and the retractable strip coupled to the body;

receiving, by the retractable portion, the at least one package;

securing, by the retractable portion, the at least one package; and notifying, by a notification system of the computer device operably connected to the apparatus, an intended recipient of delivery of the at least one package.

* * * * *